US005883648A

United States Patent [19]

Hetzer

[11] Patent Number: 5,883,648

[45] Date of Patent: Mar. 16, 1999

[54] ARRANGEMENT FOR KEEPING THE NOZZLES OF AN INK PRINT HEAD CLEAN

[75] Inventor: Ulrich Hetzer, Berlin, Germany

[73] Assignee: Francotyp-Postalia AG & Co., Birkenwerder, Germany

[21] Appl. No.: 659,299

[22] Filed: Jun. 6, 1996

[30] Foreign Application Priority Data

Jun. 19, 1995 [DE] Germany ..... 195 22 594.5

[51] Int. Cl.[6] ..... B41J 2/165

[52] U.S. Cl. ..... 347/33; 347/29; 347/30

[58] Field of Search ..... 347/24, 33, 29, 347/30, 32, 44, 92, 67

[56] References Cited

U.S. PATENT DOCUMENTS

| | | | |
|---|---|---|---|
| 4,367,479 | 1/1983 | Bower | 347/30 |
| 4,371,881 | 2/1983 | Bork et al. | 347/30 |
| 4,417,259 | 11/1983 | Maeda | 347/31 |
| 4,450,454 | 5/1984 | Koto . | |
| 4,558,332 | 12/1985 | Takahaski . | |
| 4,638,336 | 1/1987 | Hofmann . | |
| 4,684,963 | 8/1987 | Naka | 347/29 |
| 4,908,636 | 3/1990 | Saito et al. . | |

FOREIGN PATENT DOCUMENTS

| | | | |
|---|---|---|---|
| 0 285 155 | 3/1988 | European Pat. Off. . | |
| 38 25 045 | 1/1990 | Germany . | |
| 38 25 046 | 1/1990 | Germany . | |
| 40 00 416 | 11/1991 | Germany . | |
| 2-16056 | 4/1990 | Japan | 347/44 |

*Primary Examiner*—N. Le
*Assistant Examiner*—Craig A. Hallacher
*Attorney, Agent, or Firm*—Hill & Simpson

[57] ABSTRACT

In arrangement for keeping clean the nozzles of an ink print head with a large number of nozzles, the printhead having an ink print module or of several ink print modules assembled in stacked construction, and a seal bonnet and a wiping lip arranged positionally on the ink print head, a cleaning module is provided alongside the ink print modules on the ink print head, and the seal bonnet is flexibly positioned on the ink print head and is formed so that the front surface of all the ink print modules, as well as the front surface of the cleaning module, can be simultaneously covered. In addition, the seal bonnet is kinematically coupled with the wiping lip. Cleaning ensues by expelling ink and/or suctioning ink into the seal bonnet, and subsequently emptying the seal bonnet of ink, and mechanically wiping off the ink print head.

21 Claims, 8 Drawing Sheets

ARRANGEMENT FOR KEEPING THE NOZZLES OF AN INK PRINT HEAD CLEAN

BACKGROUND OF THE INVENTION

1. Field of the Invention

The invention concerns a method and an arrangement for keeping the nozzles of an ink print head clean, in particular of an ink print head having a large number of nozzles.

2. Description of the Prior Art

Ink print heads are provided for use in small, fast printers, which themselves are a component of modern machines for franking postal materials or for printing addresses or for product labeling.

In contrast to the usual office printers with line-by-line printing, the printing ensues as a unique impression in one passage of the print medium. Due to this necessarily larger printing breadth (approximately an inch), the number of ink nozzles to be arranged under one another is substantially more than in ink print heads for office printers. In order to fulfill current customer desires (blocks with word and image characters) for franking machines with good print quality, print resolutions of close to 200 dpi (dots per inch) are required. This means ink print heads with 200 nozzles.

In these print heads it must be ensured that relevant security-oriented print image data, such as value, date and machine number for franking machines, are printed without omission of print points (dots).

Since fast-drying inks must be used, there is a high risk that the ink will dry in the nozzles that are not used (activated) for a longer time, or that the nozzles will become clogged by the accumulation of dust and ink residue in the area of the nozzles.

For preventing or remedying clogging of the nozzles, a number of different solutions is known, such as uncovering and vacuuming of the nozzle surface of the ink print head, expelling ink through all nozzles, wiping the nozzle surface with a wiping lip, and supplying cleaning agents to the nozzle surface; see German OS 38 10 698 and European Application 0 285 155.

All these measures have in common that they ensue exclusively during print pauses, whose spacing can be far apart in time from one another in printers that print frequently and for long durations, such as franking machines. Clogging is accordingly probable.

An ink jet printer with several nozzles is known (German OS 33 11 735) in which detection means registers when a nozzle or several nozzles are in an unused state for a predetermined time period, and in which the result of the detection is evaluated by control means, and ink is caused to be expelled through the nozzles concerned. In other words, the time duration of the print pauses is measured by signal measurement means, and if the print pause exceeds a predetermined time limit, rinsing of the nozzles used for printing is carried out by rinsing means before printing. In order to be fairly certain that the nozzles also remain truly capable of functioning, the print pauses must be relatively short; accordingly, the writing operation must be interrupted for the purpose of cleaning. Thus the operating time of the printer is reduced and the ink consumption is essentially increased by this cleaning method.

Furthermore, a cover for the nozzles of a partial-vacuum ink print head operating with fast-drying inks is known; cf. European Application 0 173 939. By means of the cover, it is intended that the ink be prevented from drying at the nozzle ends in the print pauses, while it is also intended to ensure that the ink meniscus is neither touched nor pushed back.

For this purpose, the cover has a circumferential sealing element and a membrane, which form a pressure chamber when the cover is set on the nozzle surface. The internal tension of the membrane is smaller than the surface tension of the ink meniscuses. In this relatively small pressure chamber, a rapid saturation of the air with moisture occurs as a result of ink solution agents that evaporate at first, so that drying out of the nozzles is avoided over shorter print pauses. This arrangement, however, does not offer protection against nozzles drying out that are not used for a longer time during operation.

Another known apparatus (cf. German OS 38 25 045 and German OS 38 25 046) for cleaning the nozzle surface of an ink print head has a wiping element arranged movably in front of the nozzle surface, and in addition to the ink nozzles has a nozzle from which cleaning fluid is expelled against a guard screen and is diverted from this screen onto the nozzle surface. The wiping element is a belt that contains a number of openings adjacent to one another in the direction of the belt, the belt being transported past the nozzle surface in one direction. According to the position of the belt, the nozzles are released (opened) or covered. The belt is fashioned as an endless belt and is contained in a belt cartridge with a drive. During print operation, the belt lies with one of its openings in front of the nozzle openings and releases these openings for the expelling of ink. In the transition from print operation to print pause, at first cleaning fluid is expelled drop by drop through the cleaning nozzle. Subsequently the belt is moved forward in its direction of transport so far that instead of the opening, the following section of the belt moves in front of the nozzle surface and covers it. The edge of the opening wipes over the nozzle surface and thereby cleans this surface of accumulated contamination.

As is clear, this apparatus serves only for a rough cleaning of the nozzle surface. Clogging of the nozzle openings as the belt slides by is not precluded, nor is a drying out of nozzles.

In another known method (cf. German 32 03 014), an air cell is positioned in front of the nozzle opening for preventing clogging of the nozzles of an ink printer. This cell has an outer opening aligned with the nozzle opening, through which outer opening the ink drops fly onto the print medium. During operation, the ink jet is accompanied by an air jet from the air cell that annularly surrounds the ink jet, and is thereby accelerated. During a print pause, in order to keep the nozzle moist, the outer opening of the air cell is closed by means of a porous covering body and the moisture in the air cell is increased by letting ink into the air cell while the air is evacuated from the air cell.

At the beginning of the print operation, the ink in the air cell is rinsed out of this air cell through the outer opening by means of increased air pressure. For this purpose, the covering body is turned away, and a receptacle holder for the ink is brought in front of the outer opening. After emptying the air cell, the outer opening is blown free of ink by the air streaming through. The receptacle holder is removed and the print medium is brought into position.

The apparatus for accomplishing this known method includes an impulse-actuated pressure cell, an ink cell pressure-coupled with the pressure cell and connected to an ink cartridge via an ink duct, an air cell that is divided from the ink cell by a wall having a first opening and that is connected with the atmosphere by an outer opening, and a pump that during operation is connected with the air cell via an air line and that places the air line under a partial vacuum when operation is not taking place.

A cover apparatus can be positioned in front of the outer opening, and a valve is contained in the air line that relieves the pressure in the air line during non-pressure operation, and in preparation for the print operation raises the pressure so far that the ink contained in the air cell is pressed out through the outer opening. A receiving container, adjustable in two positions, is arranged for collecting the ink pressed out of the air cell.

An ink level state sensor in the air line switches off the supply of ink if the ink level reaches the sensor.

Although it is advantageous to integrate a part of the cleaning apparatus in the ink print head, this solution still has some disadvantages. Protection against drying out and clogging ensues in this known apparatus only during print pauses. The air stream during operation can lead to a faster drying out, at least for the nozzles that are seldom or not at all used. Since the printing ink is also used to maintain moisture in the print pauses and is then pressed into an external receptacle holder each time before printing begins, this procedure is costly with respect to time; moreover, ink is lost each time. Also, the ink meniscus can be pushed back to an undesirable extent.

Moreover, the mechanical expense (a covering body as well as a receptacle holder that can be positioned outside the ink head, and also a pump with a valve and a sensor inside the ink head) is considerable.

SUMMARY OF THE INVENTION

An object of the present invention is to increase the reliability of ink heads of the type described above at a low expense.

The underlying aim of the invention is to find a solution by means of which all the nozzles of an ink print head can be quickly cleaned in the print pauses and are protected against drying out. In addition, cleaning should be possible to remove any ink residues deposited on the nozzle surface, and the masses of the cleaning apparatus that are to be moved should be small. The cleaning apparatus should have no influence on the spacing between the ink print head and the print medium, and no influence on transport speed.

The immediate arrangement of a cleaning module on the ink print head, which can consist of one or more ink print modules, and the incorporation of the seal bonnet into the cleaning process lead to a surprisingly small, compact arrangement, having only small moved masses.

Although a precise positioning is required during the attachment of the ink print head to the cleaning apparatus, this problem is solved in a simple manner by the flexible coupling of the seal bonnet to the ink print head and its drive directly on the ink print head.

In the context of the small dimensions and construction of a printer of the type in question, simple small solutions of the cleaning apparatus are possible, since the printing and the cleaning elements, including the pump and suction tank, are located on the same side and do not influence the print medium area. All assemblies can be housed in a housing area.

Since the cleaning module terminates immediately on the ink print head, or is an integral component of it, it is sufficient for the seal bonnet to have dimensions that are only insignificantly larger than those required for the covering of the nozzle surface.

In a construction of the ink print head with inclined rows of nozzles, e.g. a non-interlaced design, the corner space, which is free in any case, can be put to use for the cleaning module.

The interruption of print operation for the purpose of cleaning can be limited to the shortest time necessary, since ink residue is removed from the seal bonnet via the lateral suction duct while the bonnet is pivoted away from the ink print head; print operation is accordingly possible during that time.

The construction of the lever supporting the wiping lip, having two external projections, ensures that the wiping lip always slides over the nozzle surface with the same application force.

By varying the number of suction ducts and the chamber construction of the seal bonnet, not only is a group-by-group suctioning advantageously possible for color ink print heads, but also an acceleration of the cleaning process is obtained.

DESCRIPTION OF THE PREFERRED EMBODIMENTS

The figures are shown schematically to facilitate the representation and comprehension.

Figure 1:
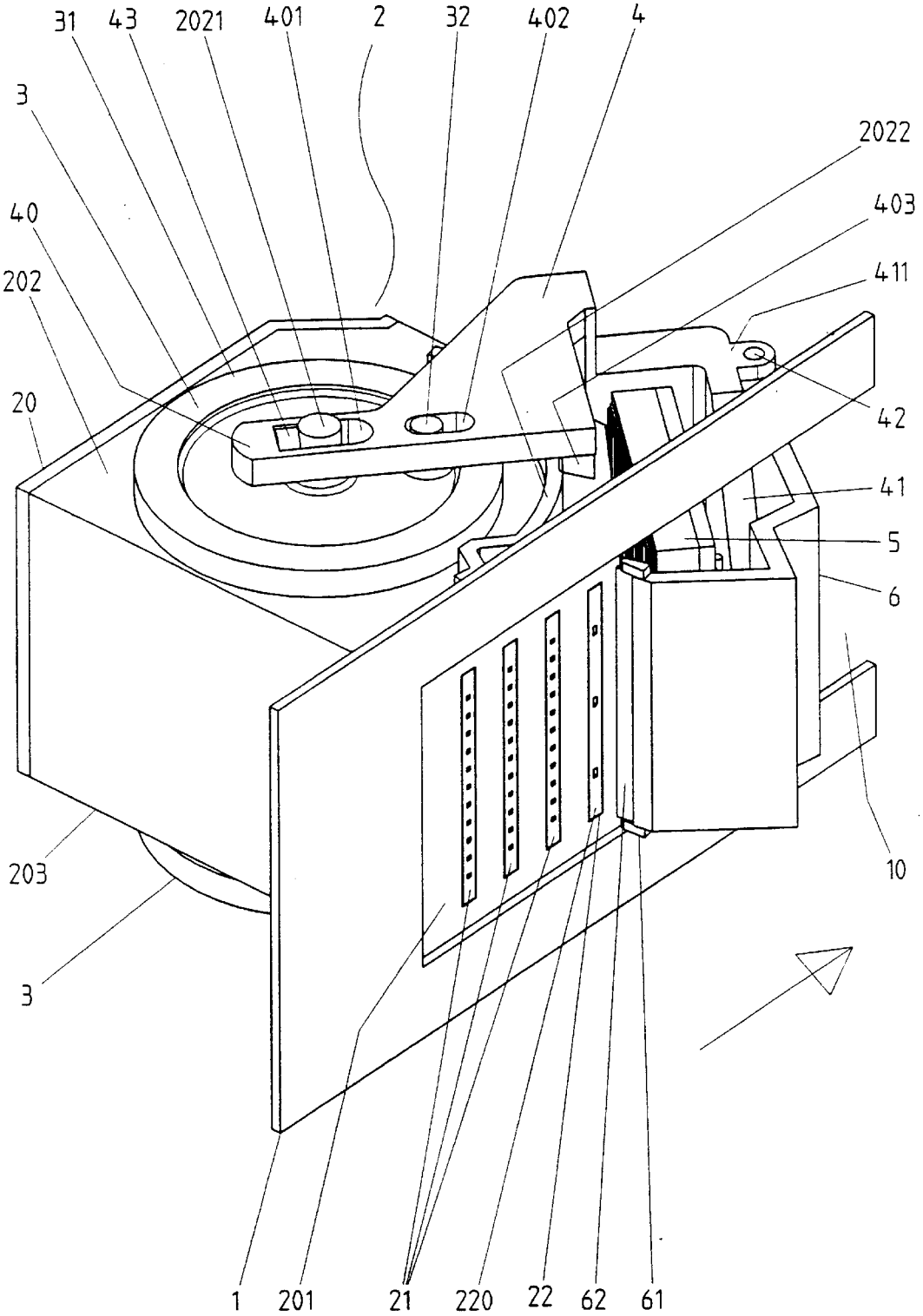
FIG. 1 is a perspective representation of an ink print head with a cleaning module attached to the ink print modules, and a seal bonnet, partly pivoted away, constructed in accordance with the principles of the present invention.

As shown in FIG. 1, an ink print head 2 contains three ink print modules 21 and a cleaning module 22, attached to the ink print modules 21 so as to be parallel thereto. The front surface 201 of the ink print head 2 projects into an opening 10 of a guide plate 1. The print medium (not shown), such as postal material, is led past the guide plate while lying thereon, in the direction of the arrow.

The ink print module 21 and the cleaning module 22 are commonly housed in the housing 20 of the ink print head 2.

A tappet 2021 is integrally formed onto the top surface 202 of the housing 20. Analogously, a tappet (not visible here) is integrally formed onto the base surface 203. A toothed wheel 3 is rotatably attached to each of the tappet 2021 and the other tappet.

The toothed wheel 3 has an external toothed wheel rim 31 and, inside the latter, a driving tappet 32. A bow-shaped lever 4 with two legs 40 is attached to both the tappet 2021 and the other tappet, as well as to the driving tappet 32. For this purpose, the lever 4 is provided with a first oblong hole 401 in the area of each of its legs 40, respectively for the tappet 2021 and the other tappet, and with a second oblong hole 402 for the driving tappet 32. The two oblong holes 401 and 402 lie in alignment, one behind the other.

Moreover, a guide strip 2022 is integrally formed onto the top surface 202. Analogously, a guide strip (not visible) is integrally formed onto the base surface 203. Both guide the strip 2022 and the other guide strip serve for guiding the bow-shaped lever 4, which has projections 403 in the interior of its legs 40, which projections 403 lie on the exterior contour of the guide strip 2022 and the other guide strip so as to be moveable along that exterior contour. A pressure spring 43 is arranged between the tappet 2021 and the external end of the oblong hole 401, and a pressure spring is also provided at the analogous location at the base 203.

The bow-shaped lever 4 supports a seal bonnet 5 in the middle of the connection piece 41 between the legs 40. In addition, eyes 411 are integrally formed onto the connection piece 41 for accepting an axle 42. A hook-shaped lever and a spring 63 are rotationally arranged on the axle 42. The spring 63 is supported on one side on the connection piece 41 and on the other side on the lever 6; cf. also FIG. 4. The lever 6 carries a wiping lip 62 at its end opposite the point of rotation, and is provided with projections 61 at the corners of the front edge that are somewhat shorter than the width of the wiping lip 62. The lever 6 is pressed against the front surface 201 by the spring 63 such that the projections 61 lie on the front surface and the wiping lip 62 is bent around; see also detail FIG. 3.

By means of the applied projections 61, a bending of the wiping lip 62 that is always the same, and thereby a constant application pressure of the lip 62 is achieved.

Figure 2:
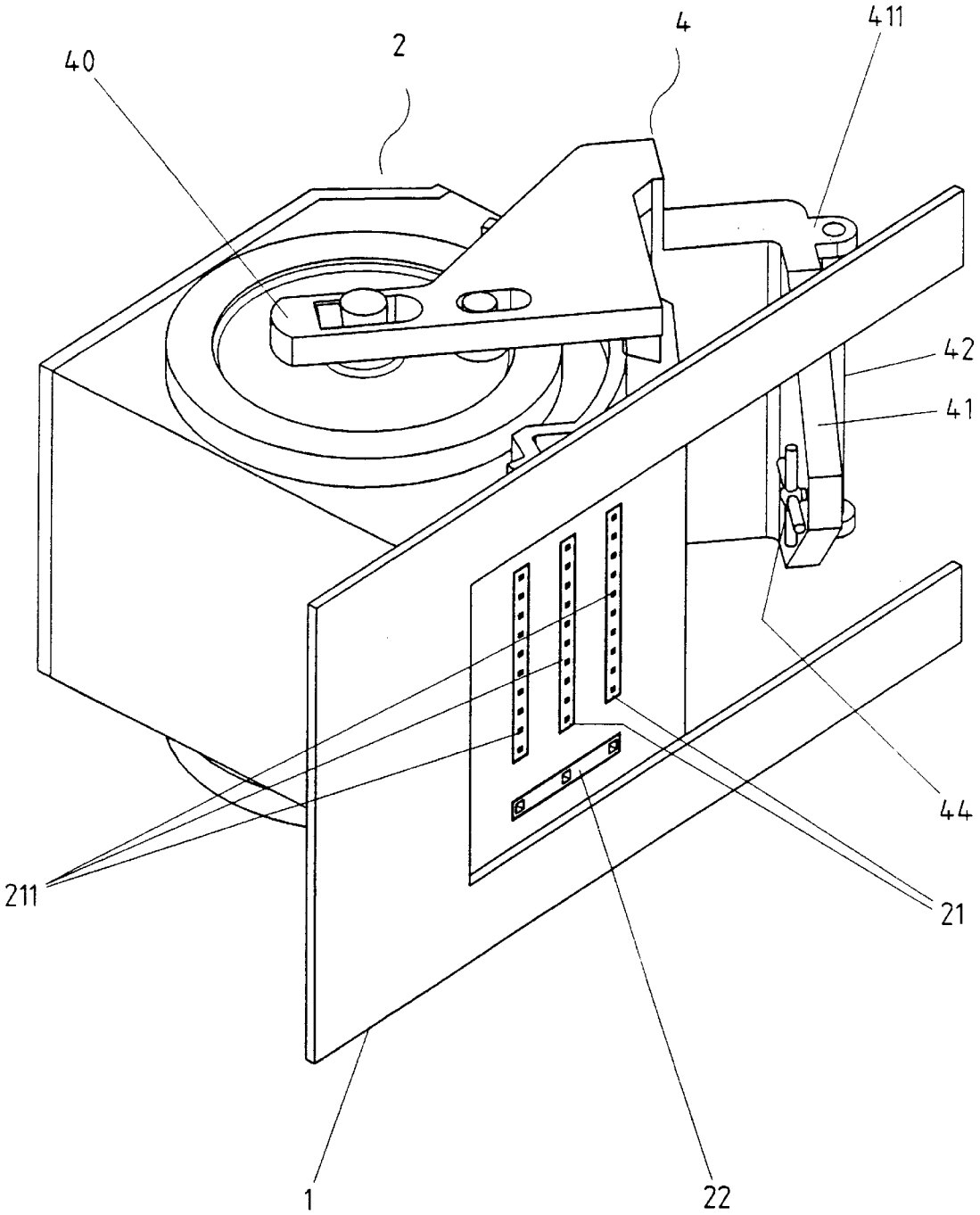
FIG. 2 is a perspective representation of an ink print head with a cleaning module lying across the ink print modules, constructed in accordance with the principles of the present invention.

In FIG. 2, the ink print head 2 contains three ink print modules 21 and a cleaning module 22 arranged crosswise under the ink print modules 21; otherwise, the relations are analogous to FIG. 1. The seal bonnet 5 is here removed. A cruciate linkage 44 is thereby easily visible, which is fastened in the connection piece 41 of the bow-shaped lever 4 and serves for the jointed connection of this lever 4 with the seal bonnet 5.

Figure 3:
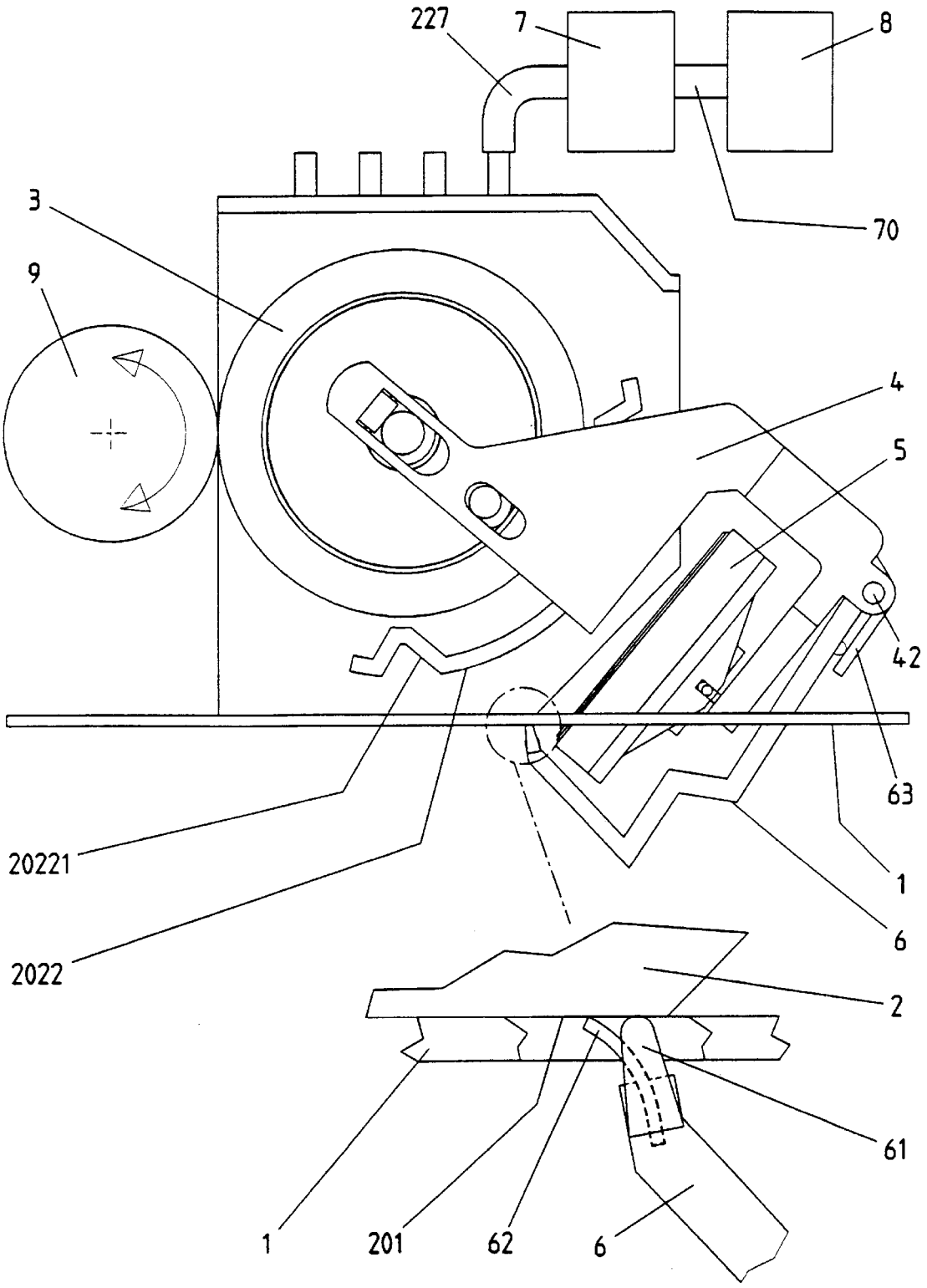
FIG. 3 is a schematic top view of the ink print head with seal bonnet and its drive, suction pump and suction tank, as well as a detail of the wiping lip, constructed in accordance with the principles of the present invention.

FIG. 3 schematically shows the drive 9 for the toothed wheel 3 for operating, via the bow-shaped lever 4, the cruciate linkage 44 coupled to the seal bonnet 5. The drive 9 can be a servomotor with an attached toothed wheel.

Moreover, the connection of the ink print head 2 or of the cleaning module 22 to an external suction pump 7 via a connecting tube 227 is visible. The suction pump 7 in turn is connected via a tube 70 with a suction tank 8, which can be exchangeable (removable) for emptying, as needed.

A first bend 20221 in the guide strip 2022 provides a fixed stop for the projection 403 of the bow-shaped lever 4. As is clear, in this end position the seal bonnet 5 is drawn against the front surface 201 by the spring 43.

Figure 4:
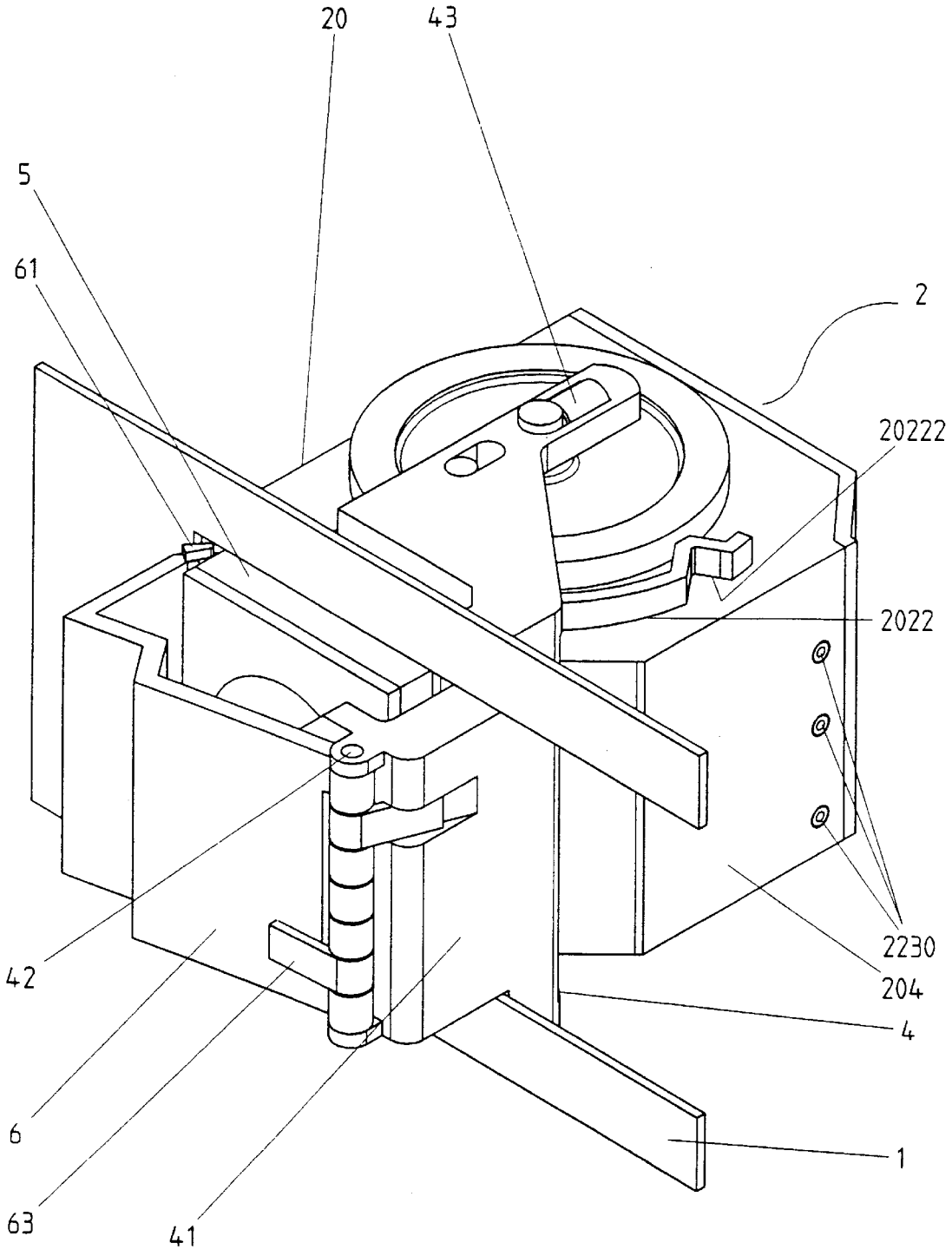
FIG. 4 is a perspective view of an ink print head with seal bonnet set on the nozzle surface, constructed in accordance with the principles of the present invention.

FIG. 4 shows the relations when the seal bonnet 5 is rotated in front of the front surface 201. A second bend 20222 in the guide strip 2022 for the other end position is clearly recognizable here, as are suction openings 2230 in the side surface 204 of the housing 20 of the ink print head 2. When the seal bonnet 5 is in this position the suction pump 7 is operated. Since the seal bonnet seals a volume containing both the cleaning module 22 and one or more ink print modules 21, the suction produced through the cleaning module 22 draws excess ink from the nozzle openings of the ink print module 21. This ink is suctioned into the suction tank 8 via the ducts described below (shown in FIG. 5), the tube 227, the pump 7, and the tube 70.

Figure 5:
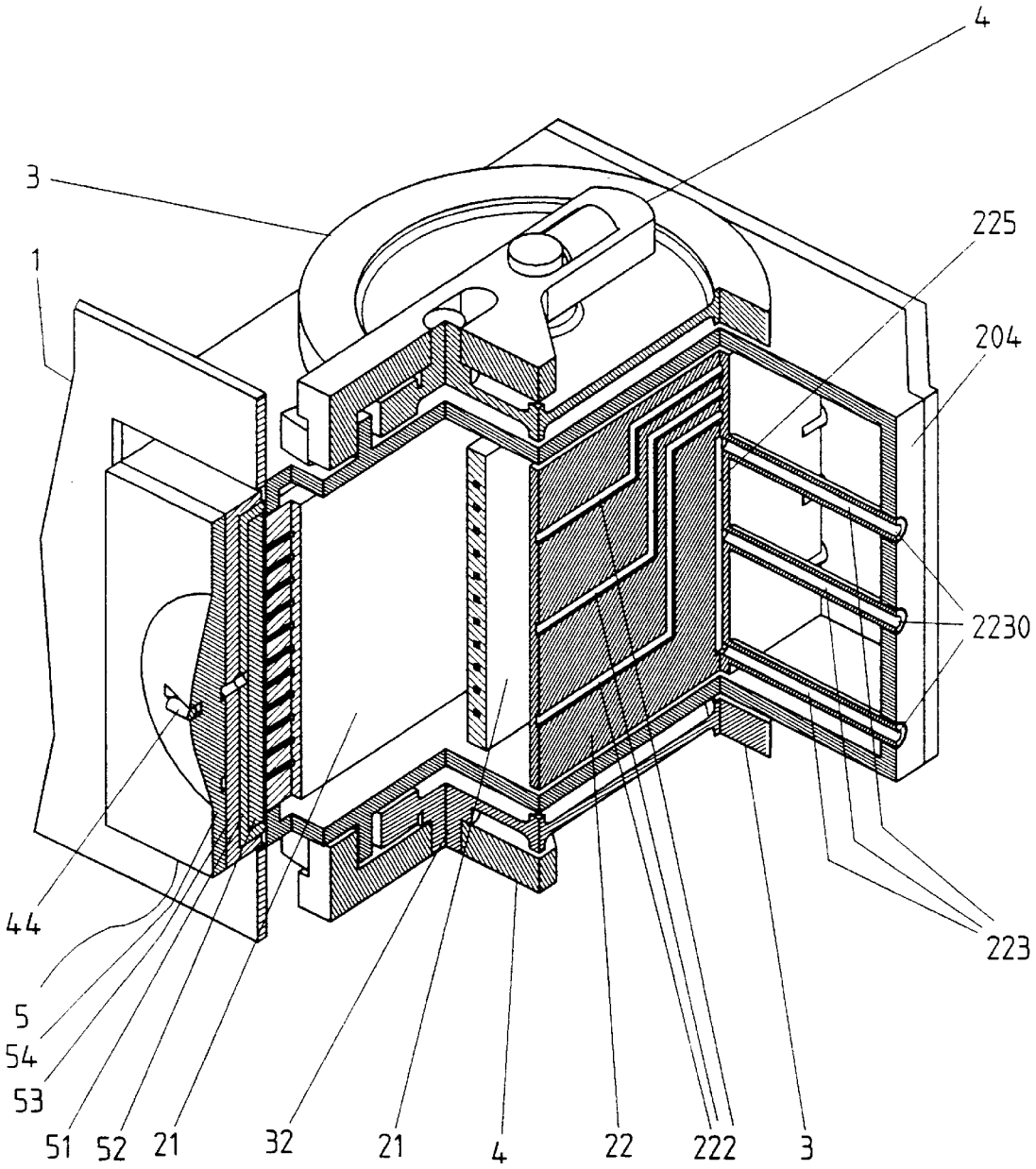
FIG. 5 is an angle section according to FIG. 4 without wiping lip, constructed in accordance with the principles of the present invention.

In FIG. 5, by means of the angle section, the relations according to FIG. 4 in the interior of the ink print head 2 are shown. Three suction ducts 222 run from the front side 220 (see also FIG. 1) of the cleaning module 22 to the exit. Three further suction ducts 223 open on one side with the suction openings 2230 in the side surface 204 of the ink print head 2 and on the other side in a common connection duct 225 that leads to a suction pump 7 (not shown). The nozzle openings 211 of the ink print module 21 are covered by the seal bonnet 5 with suction cushions 52. The suction cushion 52 is positioned in a seal 51, and this in turn is positioned in a basin 53 which is fastened to a closing plate 54, in which the cross joint 44 engages. The lever 6 with the wiping lip 62 is omitted for clarity.

Figure 6:
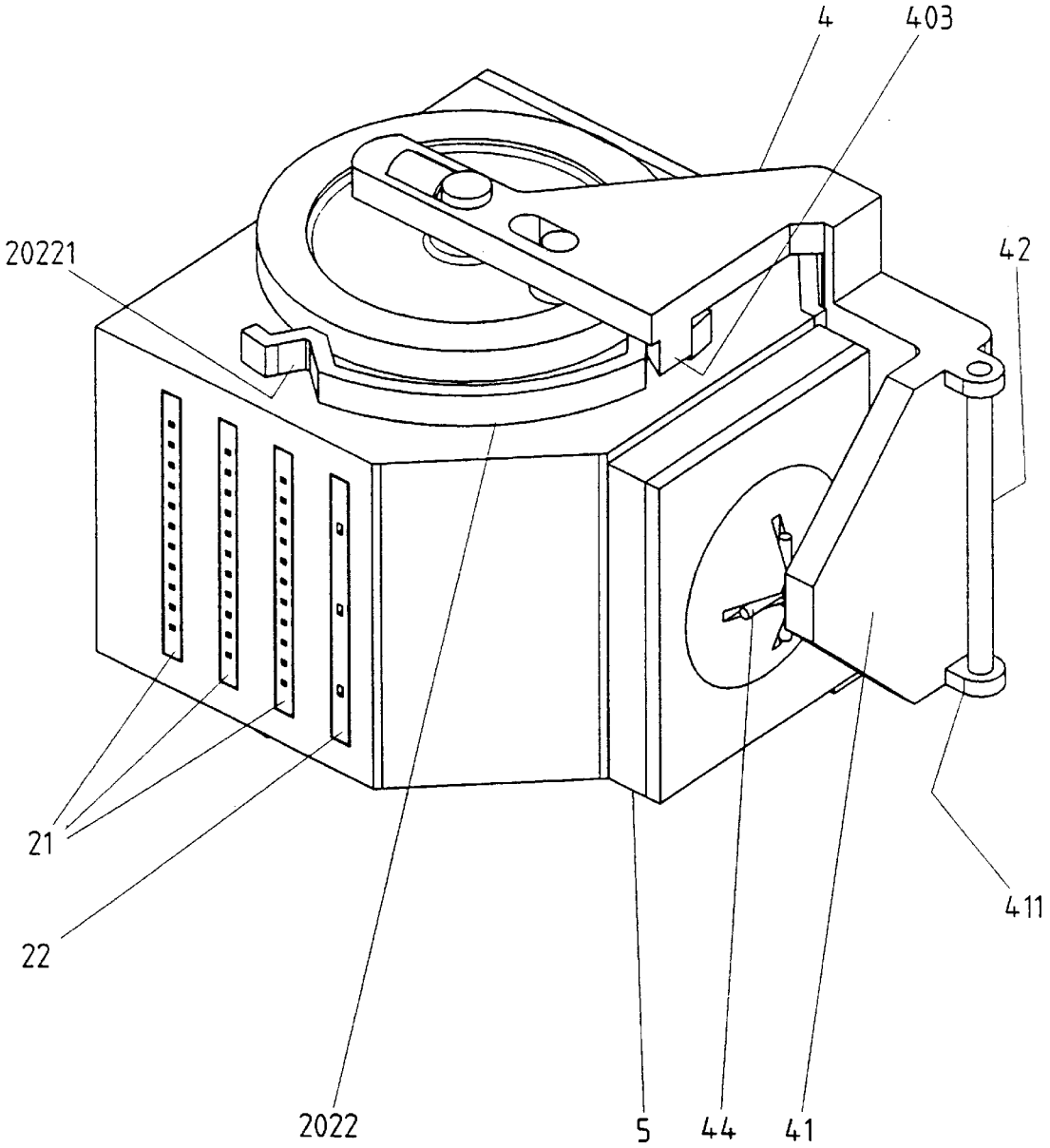
FIG. 6 is a perspective view of an ink print head with cleaning module, and seal bonnet set on a side surface, constructed in accordance with the principles of the present invention.

FIG. 6 shows the ink print head 2 with the seal bonnet 5 rotated into the second end position. The projection 403 of the lever 4 is hereby engaged in the second bend 20222 of the guide strip 2022, and the seal bonnet 5 lies on the side surface 204.

It can be clearly recognized that, during motion from the oblique position of the bends 20221 and 22222, the bow-shaped lever 4 slides with its projection 403 on the outer contour, and thereby the seal bonnet 5 is lifted from the ink print head 2; accordingly, rubbing on the surfaces 201 or 204 is avoided.

Figure 7:
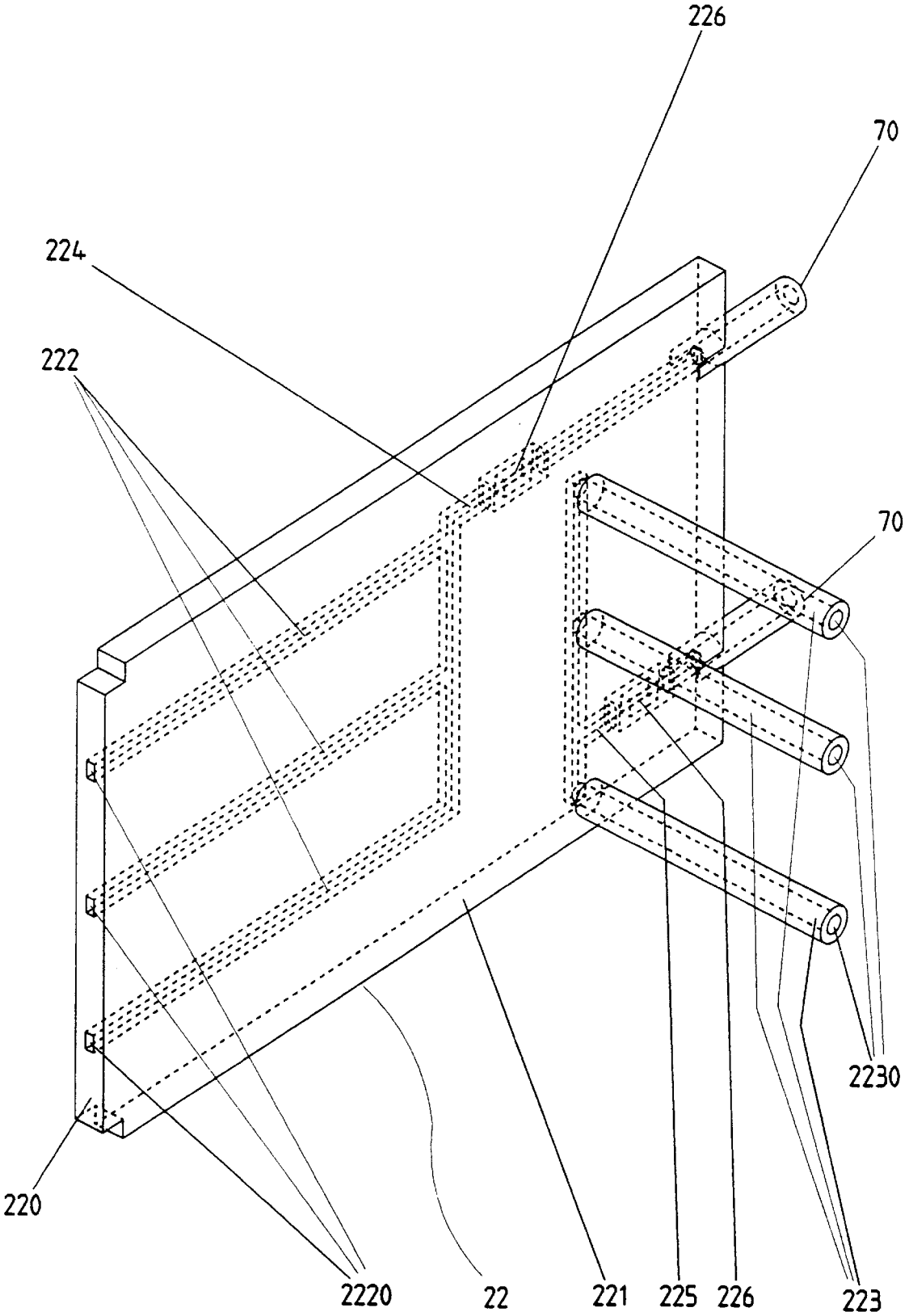
FIG. 7 is a perspective view of a cleaning module, constructed in accordance with the principles of the present invention.

FIG. 7 shows a cleaning module 22 whose suction ducts 222, opening on the front side, are combined through a common connecting duct 224 in which a suction pump, in the form of a microstructured (micromechanical) pump 226, is integrated.

At the exit side, only a tube 70 to the suction tank 8 is then additionally required. Analogously, the laterally opening suction ducts are combined to a common connection duct 225, in which a microstructure pump 226 is likewise integrated.

Figure 8:
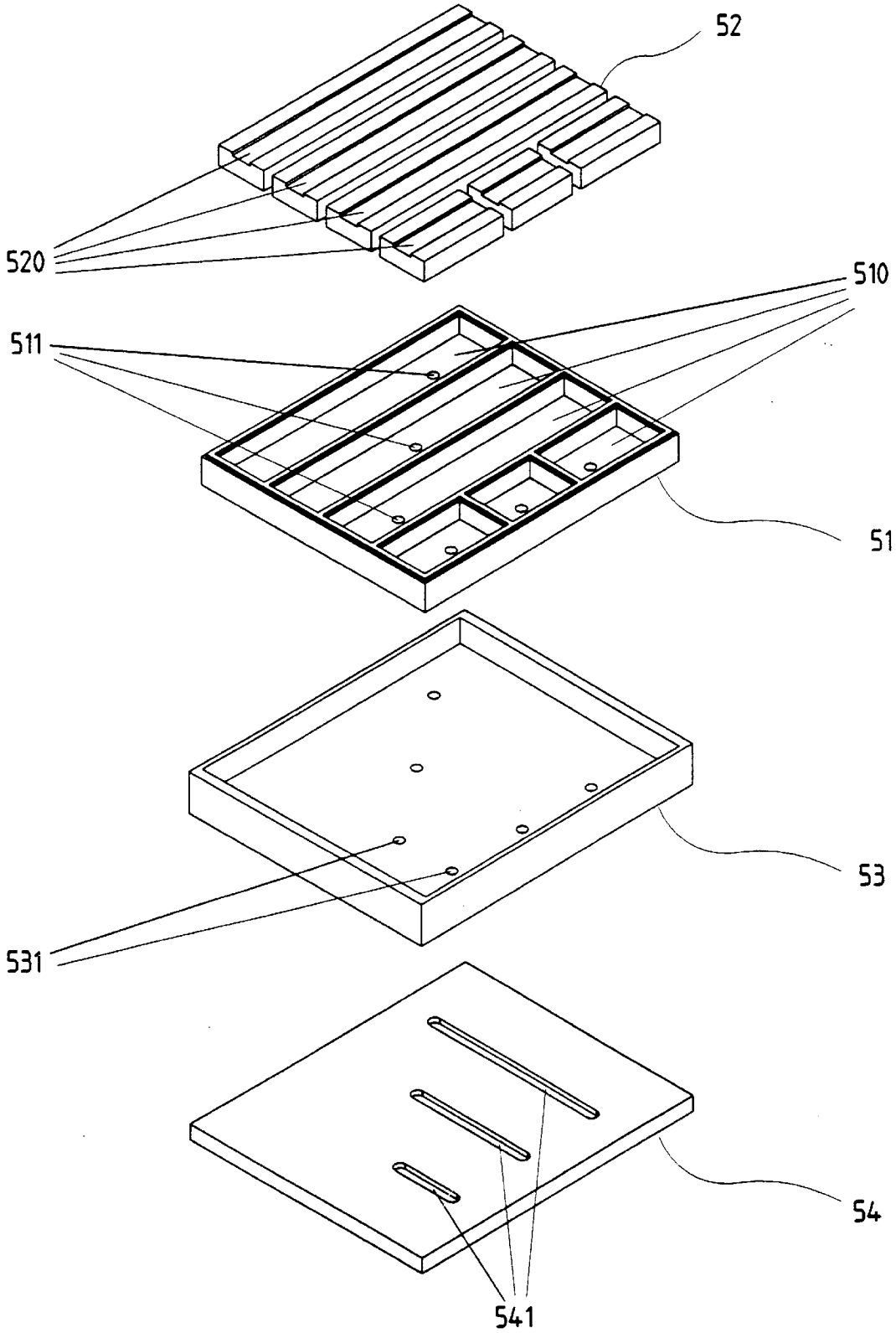
FIG. 8 is an exploded view of the seal bonnet constructed in accordance with the principles of the present invention.

In FIG. 8, the construction of the seal bonnet 5 is made clear. The suction pad 52 is matched on one side to the rows 211 of nozzles (see also FIG. 2), and is provided for this purpose with grooves 520 so that an immediate contact is avoided. On the other side, the suction pad 52 is matched to the structure of the seal 511, which is provided with chambers 510. A chamber 510 is allocated to each ink print module 21 and each suction duct opening at the front side. An opening 511 leads from the base of each chamber 510 to connection ducts 541, via an allocated opening 531 in the basin 53 accepting the seal 51. The connection ducts 541 are formed in the closing plate 54 in such a way that a connection is made between the part of the seal bonnet 5 allocated to the ink expulsion area and the part of the seal bonnet 5 allocated to the ink suction area. Of course, the basin 53 and the closing plate 54 can be combined into one part.

Although modifications and changes may be suggested by those skilled in the art, it is the intention of the inventors to embody within the patent warranted hereon all changes and modifications as reasonably and properly come within the scope of their contribution to the art.

I claim as my invention:

1. In a printing apparatus having a printing head containing at least one ink print module having a plurality of ink nozzles through which ink is ejected to produce an ink image on a recording medium, the improvement of an arrangement for keeping said nozzles clean, comprising:

a cleaning module disposed on said ink print head adjacent said at least one ink print module, said cleaning module having at least one suction duct;

a seal bonnet;

a wiping lip;

means on which said wiping lip and said seal bonnet are mounted for moving said seal bonnet from a standby position remote from, to a cleaning position enclosing a sealed volume common to said cleaning module and said at least one ink print module and for moving said wiping lip over said cleaning module and said at least one ink print module as said seal bonnet is moved from said standby position to said cleaning position; and means including a pump for producing suction in said enclosed volume, via said cleaning module, for cleaning ink from said nozzles while said seal bonnet is in said cleaning position, said pump having an input connected to said at least one suction duct and having an output connected to a tank which receives ink cleaned from said nozzles.

2. The improvement of claim 1 wherein said nozzles are arranged in a row in said at least one ink print module, and wherein said cleaning module is disposed substantially parallel to said row.

3. The improvement of claim 1 wherein said nozzles are arranged in a row in said at least one ink print module, and wherein said cleaning module is disposed substantially perpendicular to said row.

4. The improvement of claim 1 wherein said cleaning module comprises at least one suction duct, and wherein said means for producing suction comprises a suction pump, disposed outside of said ink print head, and having an input connected to said at least one suction duct and an output connected to a tank which receives ink cleaned from said nozzles.

5. The improvement of claim 1 wherein said pump comprises a micro structured pump, contained in said ink print head.

6. In a printing apparatus having a printing head containing at least one ink print module having a plurality of ink nozzles through which ink is ejected to produce an ink image on a recording medium, the improvement of an arrangement for keeping said nozzles clean, comprising:

a cleaning module disposed on said ink print head adjacent said at least one ink print module;

a seal bonnet;

a wiping lip;

means on which said wiping lip and said seal bonnet are mounted for moving said seal bonnet from a standby position remote from, to a cleaning position enclosing a sealed volume common to said cleaning module and said at least one ink print module and for moving said wiping lip over said cleaning module and said at least one ink print module as said seal bonnet is moved from said standby position to said cleaning position;

means for producing suction in said enclosed volume, via said cleaning module, for cleaning ink from said nozzles while said seal bonnet is in said cleaning position; and said ink print head having a front surface at which said nozzles are disposed, and an adjacent side surface, and said cleaning module having at least one suction duct connected to said means for producing suction and extending between said front surface and said adjacent side surface.

7. The improvement of claim 6 wherein said cleaning module contains a plurality of suction ducts opening at said front surface, and a common connection duct, to which all of said plurality of suction ducts are connected, opening at said side surface, and wherein said means for producing suction comprises a suction pump having an input connected to the opening of said common connection duct at said side surface.

8. The improvement of claim 6 wherein said cleaning module comprises a plurality of suction ducts having respective openings in said front surface and a common connection duct, to which all of said plurality of suction ducts are connected, said suction duct opening at said side surface, and wherein said means for producing suction comprises a microstructured pump disposed in said connection duct and a suction tank connected to the opening of said connection duct in the side surface.

9. The improvement of claim 1 wherein said seal bonnet includes a seal consisting of elastic material and a suction pad.

10. The improvement of claim 1 wherein said seal bonnet includes a seal consisting of elastic material and a suction pad, and wherein said seal bonnet includes a seal consisting of elastic material and a suction pad, said seal being divided into a plurality of chambers corresponding in number to the plurality of suction ducts and the plurality of ink print modules.

11. The improvement of claim 1 wherein said seal bonnet includes a seal consisting of elastic material and a suction pad, and wherein said seal bonnet includes a seal made of elastic material and a suction pad and at least one seal bonnet connection duct, disposed in said seal bonnet on a side of said suction pad opposite said enclosed volume and extending, when said seal bonnet is in said cleaning position, between a region of said enclosed volume in registry with said nozzles and a region of said enclosed volume in registry with said cleaning module.

12. The improvement of claim 1 wherein said seal bonnet includes a seal consisting of elastic material and a suction pad, and wherein said seal bonnet includes a seal consisting of elastic material and a suction pad, said suction pad having a plurality of grooves therein respectively in registry with said nozzles of the respective ink print modules.

13. The improvement of claim 1 wherein said ink print head has a housing with a top surface and a base surface, and wherein said means for moving said seal bonnet and said wiping lip comprise:

a first wheel mounted to rotation around a first axle on said top surface and a second wheel mounted for rotation around a second axle on said base surface, said first wheel having a first tappet projecting therefrom spaced from said first axle and said second wheel having a second tappet projecting therefrom spaced from said second axle;

a frame having a first leg adjacent said first wheel and engaging said first axle and said first projection and a second leg adjacent said second wheel and engaging said second axle and said second projection, said seal bonnet being mounted on said frame between said first and second legs;

a first curved guide element disposed on said top surface of said housing and a second curved guide element disposed on said base surface of said housing, and said first leg having a first leg projection disposed for riding against said first curve guide element and said second leg having a second leg projection disposed for riding against said second curved guide element; and means engaging said first and second wheels for rotating said first and second wheels for causing said frame to co-rotate with said first and second wheels along a path defined by said first and said second curved guide elements from said standby position to said cleaning position.

14. The improvement of claim 13 wherein each of said first and second curved guide elements comprises a curved guide strip, and wherein said first and second leg projections respectively ride against a surface of said curved guide strips.

15. The improvement of claim 13 further comprising first spring means for maintaining said first leg in engagement with said first axle and said first projection, and second spring means for maintaining said second leg in engagement with said second axle and said second projection.

16. The improvement of claim 15 wherein each of said first and second curved guide elements has a bent portion at said cleaning position, said first and second leg projections being forced into the respective bent portions by said spring means at said cleaning position to pull said seal bonnet toward said at least one nozzle module and said cleaning module to seal said seal bonnet there against, and wherein said first leg has two oblong holes therein in which said first axle and said first projection are respectively received, and wherein said second leg has two oblong holes therein in which said second axle and said projection are respectively received, for permitting radial movement, relative to said first and second wheels, of said frame when said first and second leg projections engage the respective bent regions.

17. The improvement of claim 13 wherein each of said first and second wheels comprises a wheel having a tooth rim, and wherein said means for rotating said first and second wheels comprises means engaging the respective tooth rims of said first and second wheels.

18. The improvement of claim 13 further comprising a cruciate linkage mounting said seal bonnet on said frame.

19. The improvement of claim 13 wherein said means for moving said seal bonnet and for moving said wiping lip further comprise:

a hook-shaped lever having a first and at which said wiping lip is mounted and a second end, opposite said first end;

an axle mounted on and carried by said frame to which said second end of said hook-shaped lever is mounted, permitting rotation of said hook-shaped lever relative to said frame; and spring means, associated with said axle and said second end of said hook-shaped lever, for urging said wiping lip into wiping engagement with said at least one ink module as said first and second wheels and said frame are rotated from said standby position to said cleaning position.

20. The improvement of claim 19 wherein said hook-shaped lever comprises first and second spaced apart lever projections, mounted at said first end of said hook-shaped lever, said wiping lip being mounted between said first and second lever projections and extending from said first end of said hook-shaped lever beyond said first and second lever projections.

21. In a printing apparatus having a printing head containing a plurality of ink print modules having a plurality of ink nozzles through which ink is ejected to produce an ink image on a recording medium, the improvement of an arrangement for keeping said nozzles clean, comprising:

a cleaning module disposed on said ink print head adjacent all of said ink print modules, said cleaning module having a plurality of suction ducts, corresponding in number to said plurality of ink print modules;

a seal bonnet;

a wiping lip;

means on which said wiping lip and said seal bonnet are mounted for moving said seal bonnet from a standby position remote from, to a cleaning position enclosing a sealed volume common to said cleaning module and said at least one ink print module and for moving said wiping lip over said cleaning module and said at least one ink print module as said seal bonnet is moved from said standby position to said cleaning position, said plurality of suction ducts opening into said enclosed volume; and means for producing suction in said enclosed volume, via said cleaning module, for cleaning ink from said nozzles while said seal bonnet is in said cleaning position.

* * * * *